United States Patent [19]

DeCuyper et al.

[11] Patent Number: 4,482,454

[45] Date of Patent: Nov. 13, 1984

[54] PROCESS FOR TREATING CASSITERITE ORE

[75] Inventors: Jacques DeCuyper, Sterrebeek; Edwin Broekaert, Brussels, both of Belgium; Joris Van't Hoff, Puteaux, France

[73] Assignee: Ceca S.A., France

[21] Appl. No.: 440,292

[22] Filed: Nov. 9, 1982

[30] Foreign Application Priority Data

Nov. 9, 1981 [FR] France ..... 81 20966

[51] Int. Cl.[3] ..... B03D 1/14

[52] U.S. Cl. ..... 209/166; 209/167; 252/61

[58] Field of Search ..... 209/166, 167; 252/61

[56] References Cited

U.S. PATENT DOCUMENTS

| | | | |
|---|---|---|---|
| 3,822,014 | 7/1974 | Vereheyden | 209/166 |
| 4,229,287 | 10/1980 | Lepetic | 209/167 |
| 4,358,368 | 11/1982 | Hellsten et al. | 209/167 |

FOREIGN PATENT DOCUMENTS

| | | | |
|---|---|---|---|
| 914809 | 11/1972 | Canada | 209/166 |
| 2497467 | 7/1982 | France | 252/61 |
| 1451194 | 9/1976 | United Kingdom | 209/166 |

*Primary Examiner*—Bernard Nozick

*Attorney, Agent, or Firm*—Ostrolenk, Faber, Gerb & Soffen

[57] ABSTRACT

The present invention relates to a process for treating a cassiterite ore, characterized in that, just before the flotation operation, said ore is subjected to a preliminary flotation operation, using an amphoteric collector of formula:

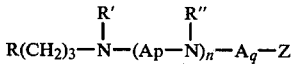

in which:

R is $R_1$ or $R_1$—O— or

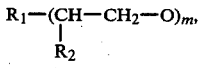

R′ is H, $CH_3$, polyoxyalkyl or $R(CH_2)_3$ or $A_q$—Z,

R″ is H or $A_q$—Z

Ap and $A_q$ are polymethylene chains,

Z is selected from the carboxylic, sulfonic or phosphonic groups.

5 Claims, No Drawings

PROCESS FOR TREATING CASSITERITE ORE

The present invention relates to the enrichment of cassiterite ores by flotation by eliminating part of the gangue by means of an amphoteric collector.

Treatments of ores by flotation are known.

They are used for ensuring a concentration of the interesting ores by partial or total separation of the elements constituting the gangue.

In a treatment of enrichment by flotation, the ore may be previously de-slimed (elimination of the fine particles, particularly the clays, by granulometric cut), then, if necessary, the large elements are ground in order to release the different mineral phases. Attrition may be added to this preparation in order to improve the cleanness of the mineral surfaces. To the mineral pulp thus formed is added a reagent, or collector, which clings to the surface of the particles either of the interesting species or of the undesirable species or gangue, rendering the surface hydrophobic. By insufflating air, the air bubbles cling to the hydrophobic surfaces and carry the particles over in the form of foam or froth representing the floated part. The species which has not retained any collector is not carried over in the froth.

The stability of the froth is generally ensured by adding to the mineral pulp so-called foaming reagents. When the form formed is excessive in volume or too stable, it is sometimes envisaged to employ froth regulating agents.

In order to avoid (or to activate) fixation of a collector on one of the mineral phases, other so-called depressing (or activating) reagents are sometimes added to the pulp, prior to the addition of the collector, which reagents cling selectively to the surface of the particles of one of the mineral phases.

Froth flotation therefore generally comprises the series of the following operations:

possible de-sliming
grinding and/or attrition
conditioning of the pulp with a depressing and/or activating agent
conditioning of the pulp with a collector
conditioning of the pulp with a foaming agent and/or a froth regulating agent
insufflation of air.

Cassiterite is an oxide of tin which exists in ores in the state of deposit formations where the mineral is either already released or finely scattered in a gangue.

In the first case, separation of the cassiterite is obtained by gravimetrical concentration treatments. In the second case, the ore is firstly ground so as to release the cassiterite. The large fractions are generally subjected to a gravimetrical concentration, whilst the cassiterite present in the fine-grained ores may be recovered by direct flotation. However, in the event of the ore containing sulfides, the latter are previously removed, likewise by direct flotation of the sulfides.

For direct flotation of the fine-grained fractions of the ore, carboxylic, phosphonic and arsenic acids have been recommended as collectors of the cassiterite, the latter acids presenting risks of toxicity which are an obstacle to their use. At present, the use of sulfosuccinamates is therefore preferred, as they ensure safer operation. Their use as collectors of cassiterite is described in particular in U.S. Pat. No. 3,469,693.

Minerals such as silicates and silico-aluminates (muscovite, chlorites, tourmaline, topaz, . . . ), fluorite, iron oxides and carbonates, particularly siderite, generally constitute a large part of the gangue of the cassiterite ores. The presence of these impurities considerably hinders flotation of the cassiterite by reducing both the selectivity and yield of tin. The lack of selectively obtained brings about the necessity of subjecting the concentrate of cassiterite to an additional treatment consisting either of a high-intensity magnetic separation or an acid lixiviation.

It has been found, and this represents the invention, that a substantial elimination of the undesirable impurities could be advantageously obtained by a preliminary flotation treatment using amphoteric collectors comprising at least one basic nitrogen and at least one acid group at the same time.

The collectors which may be used according to the invention are the products of formula:

$$R(CH_2)_3-\overset{\overset{\displaystyle R'}{|}}{N}-(Ap-\overset{\overset{\displaystyle R''}{|}}{N})_n-A_q-Z$$

in which:

R may be $R_1$, $-R_1-O-$ or $$R_1-(\underset{\underset{\displaystyle R_2}{|}}{CH}-CH_2-O)_m$$

where $R_1$ is a linear or branched, saturated or non-saturated alkyl radical, having 5 to 19 carbon atoms, or an alkylaryl radical, or a poly(oxyalkyl) radical; $R_2$ being H or $CH_3$, with the additional condition that R is a chain of lipophilic character, R′ may be H or $CH_3-$ or poly(oxyalkyl) or R′ is $R-(CH_2)_3-$ or R′ is $A_q-Z$, R″ is H or $A_q-Z$; in the case of $n>1$ there may be both substituents H and substituents $A_q-Z$, Ap and $A_q$ are polymethylene chains containing respectively p and q carbon atoms, p and q being integers from 1 to 4, n is 0 or an integer from 1 to 5, Z is a radical selected from the carboxylic, sulfonic or phosphonic groups.

According to the invention, use may particularly be made of the corresponding alkylaminopropionic, alkylaminopropylaminopropionic and alkoxypropylaminopropionic acids of formula:

$$R-(NH-CH_2-CH_2-CH_2)_n-NH-CH_2-CH_2-COOH$$

where R is $CH_3-(CH_2)_{m-1}$ or $CH_3(CH_2)_{m-1}O-CH_2CH_2CH_2-$ with m: 12 to 22, n=0, 1, 2 or 3

"Preliminary flotation" is understood to mean a flotation operation leading to the elimination of part (for example from 3 to 10% by weight) of the treated ore which is carried out on a product having undergone the preliminary operations (de-sliming, grinding) and which, in the conventional process, would be subjected to flotation.

The invention will be more readily understood from the following examples.

In these tests, normal flotation was effected according to the conventional technique in two cells; the float of the first is retreated in the second, yielding the final float and a non-float to be recirculated in the first cell where the non-float constitutes the final tailings.

Preliminary flotation was carried out in one cell, the float which contains the undesirable elements being eliminated and the non-float being taken up for supplying the normal flotation.

fluorite
quartz

Conditions of flotation (nature and consumption of the reagents, expressed in grams per ton of ore supplying the flotation process):

| | | | |
|---|---|---|---|
| | | Preliminary flotation (according to the invention)<br>pH = natural pH 5.7<br>N—alkylaminopropionic acid (alkyl being with copra chain) = 150 g/t<br>conditioning: 3 mins<br>M.I.B.C. (methylisobutylcarbinol 20 g/t) | |
| Normal flotation<br>Sulfuric acid: 5 kg/t<br>pH = 2.4<br>$Na_2SiF_6$ = 100 g/t<br>$Na_2SiO_3$ = 200 g/t<br>Conditioning: 2 mins.<br>Tetrasodium sulfosuccinamate = 300 g/t<br>Conditioning: 3 mins.<br>M.I.B.C. = 40 g/t | depressant | Normal flotation<br>Sulfuric acid: 2.7 kg/t<br>pH = 2.4<br>$Na_2SiF_6$ = 100 g/t<br>$Na_2SiO_3$ = 200 g/t<br>Conditioning: 2 mins<br>Tetrasodium sulfosuccinamate = 300 g/t<br>Conditioning: 3 mins<br>M.I.B.C. = 45 g/t | depressant |

EXAMPLE 1

Results:

| | Without preliminary flotation | | | With preliminary flotation object of the invention | | |
|---|---|---|---|---|---|---|
| | Yield in weight % | % tin | Yield in tin | Yield in weight % | % tin | Yield in tin |
| Supply preliminary flotation | — | — | — | 100.0 | 1.87 | 100.0 |
| Float | — | — | — | 3.6 | 0.79 | 1.5 |
| Supply cassiterite flotation | 100.0 | 1.87 | 100.0 | 96.4 | 1.91 | 98.5 |
| Float (cassiterite concentrate) | 7.6 | 11.32 | 46.0 | 7.6 | 12.43 | 50.5 |
| Non-float to be recirculated | 14.7 | 4.34 | 34.1 | 15.4 | 4.07 | 33.5 |
| Final tailings | 77.7 | 0.48 | 19.9 | 73.4 | 0.37 | 14.5 |

Treatment of a cassiterite ore containing, after elimination of the sulfides by flotation:
silicates
silico-aluminates (muscovite, chlorites, tourmaline)
carbonates (calcite, siderite)

EXAMPLES II AND III

The same ore is treated as in Example 1, the only differences coming from the use of various collectors according to the invention.

| | Example II | | Example III |
|---|---|---|---|
| Preliminary flotation (according to the invention | natural pH (6.6)<br>N—alkylaminopropionic acid (alkyl = radical of tallow chain) = 160 g/t<br>Conditioning: 3 mins<br>M.I.B.C. = 10 g/t | | natural pH (6.6)<br>N—octyloxypropylaminopropionic acid (alkyl = chain having 7/9 carbons) = 160 g/t<br>Conditioning: 3 mins<br>M.I.B.C. = 10 g/t |
| Normal flotation | Sulfuric acid: 2.7 kg/t<br>pH = 2.4<br>$Na_2SiF_6$ = 100 g/t<br>$Na_2SiO_3$ = 100 g/t<br>Tetrasodium sulfosuccinate = 300 g/t<br>Conditioning: 3 mins<br>M.I.B.C. = 40 g/t | depressant | Sulfuric acid: 2.8 kg/t<br>pH = 2.4<br>$Na_2SiF_6$ = 100 g/t<br>$Na_2SiO_3$ = 100 g/t<br>Tetrasodium sulfosuccinate = 300 g/t<br>Conditioning: 3 mins<br>M.I.B.C. = 40 g/t |

Results:

| | Preliminary flotation with N—alkylaminopropionic acid (alkyl = tallow) | | | Preliminary flotation with N—octyloxypropylaminopropionic acid | | |
|---|---|---|---|---|---|---|
| | Yield in weight % | % tin | Yield in tin | Yield in weight % | % tin | Yield in tin |
| Supply preliminary flotation | 100.0 | 1.86 | 100.0 | 100.0 | 1.87 | 100.0 |
| Float | 2.3 | 0.68 | 0.8 | 1.9 | 0.79 | 0.8 |
| Supply cassiterite flotation | 97.7 | 1.87 | 99.2 | 98.1 | 1.89 | 99.2 |
| Float (cassiterite concentrate) | 7.6 | 12.26 | 50.1 | 7.7 | 12.63 | 52.0 |
| Non-float to be recirculated | 15.9 | 3.33 | 30.4 | 17.8 | 3.20 | 30.5 |
| Final tailings | 74.2 | 0.47 | 18.7 | 72.6 | 0.43 | 16.7 |

EXAMPLE IV

Treatment of the same ore using as collector of normal flotation styrenephosphonic acid instead of tetrasodium sulfosuccinamate.

Conditions of flotation (nature and consumption of the reagents, expressed in grams per ton of ore supplying the flotation process):

| | Preliminary flotation (according to the invention) pH = natural pH 5.8 N—alkylaminopropionic acid (alkyl being with copra chain = 160 g/t Conditioning: 3 mins M.I.B.C.:10 g/t |
|---|---|
| Normal flotation | Normal flotation |
| Sulfuric acid: 1.1 kg/t pH = 4.5 | Sulfuric acid: 0.7 kg/t pH = 4.5 |

-continued

| | |
|---|---|
| Styrenesphosphonic acid = 390 g/t Conditioning: 3 mins M.I.B.C. = 35 g/t | Styrenephosphonic acid = 390 g/t Conditioning: 3 mins M.I.B.C. = 35 g/t |

Results:

| | Without preliminary flotation | | | With preliminary flotation object of the invention | | |
|---|---|---|---|---|---|---|
| | Yield in weight % | % tin | Yield in tin | Yield in weight % | % tin | Yield in tin |
| Supply preliminary flotation | — | — | — | 100.0 | 1.89 | 100.0 |
| Float | — | — | — | 5.1 | 1.12 | 3.0 |
| Supply cassiterite flotation | 100.0 | 1.84 | 100.0 | 94.9 | 1.93 | 97.0 |
| Float (cassiterite concentrate) | 7.8 | 8.67 | 36.6 | 6.3 | 11.79 | 39.3 |
| Non-float to be recirculated | 16.9 | 3.98 | 36.6 | 14.8 | 4.84 | 37.9 |
| Final tailings | 75.3 | 0.65 | 26.6 | 73.8 | 0.51 | 19.8 |

EXAMPLE V

Treatment of another cassitierite ore containing:

silicates
silico-aluminates (muscovite, chlorites, tourmaline)
carbonates (calcite, siderite)
fluorite
quartz Conditions of flotation (nature and consumption of the reagents expressed in grams per ton of ore supplying the flotation process):

| | | Preliminary flotation (according to the invention pH = natural pH 6.5) N—alkylaminopropionic acid (alkyl being with copra chain) = 250 g/t Conditioning: 3 mins | |
|---|---|---|---|
| Normal flotation | | Normal flotation | |
| Sulfuric acid: 3.5 kg/t pH: 2.4 $Na_2SiF_6$: 100 g/t | } depressant | Sulfuric acid: 2.3 kg/t pH: 2.3 $Na_2SiF_6$: 100 g/t | } depressant |
| $Na_2SiO_3$: 200 g/t Conditioning: 2 mins Tetrasodium sulfosuccinamate = 300 g/t Conditioning: 3 mins | | $Na_2SiO_3$: 200 g/t Conditioning: 2 mins Tetrasodium sulfosuccinamate = 300 g/t Conditioning: 3 mins | |

-continued

| M.I.B.C. = 45 g/t | | | | M.I.B.C. = 50 g/t | | |
|---|---|---|---|---|---|---|

Results:

| | Without preliminary flotation | | | With preliminary flotation object of the invention | | |
|---|---|---|---|---|---|---|
| | Yield in weight % | % tin | Yield in tin | Yield in weight % | % tin | Yield in tin |
| Supply preliminary flotation | — | — | — | 100.0 | 1.36 | 100.0 |
| Float | — | — | — | 9.0 | 0.87 | 5.7 |
| Supply cassiterite flotation | 100.0 | 1.40 | 100.0 | 91.0 | 1.41 | 94.3 |
| Float (cassiterite concentrate) | 5.7 | 6.79 | 27.5 | 5.5 | 12.12 | 49.0 |
| Non-float to be recirculated | 25.3 | 2.91 | 52.4 | 24.4 | 2.07 | 37.1 |
| Final tailings | 69.0 | 0.41 | 20.1 | 61.1 | 0.18 | 8.2 |

The preliminary flotation treatment by means of the collectors according to the invention makes it possible to obtain a significant improvement in selectivity in the course of the subsequent direct flotation of the cassiterite whilst substantially reducing the consumption of acid necessary for maintaining the pH of the flotation (in addition, the residual presence of the amphoteric collector avoids obtaining a considerable volume of very stable froth inherent in the flotation of the cassiterite with the aid of sulfosuccinamates).

What is claimed is:

1. A process for the preliminary flotation of a cassiterite ore in order to recover impurities selected from the group consisting of silicates, silicoaluminates, fluorite, iron oxides and carbonates in the float and provide an improvement in selectivity in the course of subsequent concentrations of said ore by anionic flotation, comprising the step of effecting flotation by means of an amphoteric collector of the formula:

$$R-(NH-CH_2-CH_2)_n-NH-CH_2-CH_2-COOH$$

in which:

R is $CH_3-(CH_2)_{m-1}$ or $CH_3-(CH_2)_{m-1}OCH_2CH_2CH_2-$, m is 12 to 22, and n is 0, 1, 2, or 3.

2. The process according to claim 1 wherein the collector is N-octyloxypropylaminopropionic acid.

3. The process according to claim 1, wherein the collector is N-alkylaminopropionic acid.

4. The process according to claim 3 wherein the alkyl group is a copra alkyl group.

5. The process according to claim 3 wherein the alkyl group is a tallow alkyl group.

* * * * *